US010080440B2

(12) United States Patent
Nelson

(10) Patent No.: US 10,080,440 B2
(45) Date of Patent: Sep. 25, 2018

(54) PORTABLE FOLDING TOILET CHAIR

(71) Applicant: Cabela's Incorporated, Sidney, NE (US)

(72) Inventor: Ronald D. Nelson, Sidney, NE (US)

(73) Assignee: Cabela's LLC, Sidney, NE (US)

( * ) Notice: Subject to any disclaimer, the term of this patent is extended or adjusted under 35 U.S.C. 154(b) by 29 days.

(21) Appl. No.: 15/088,420

(22) Filed: Apr. 1, 2016

(65) Prior Publication Data

US 2016/0287038 A1 Oct. 6, 2016

Related U.S. Application Data

(60) Provisional application No. 62/141,730, filed on Apr. 1, 2015.

(51) Int. Cl.

| | |
|---|---|
| ***A47C 5/10*** | (2006.01) |
| ***A47K 13/00*** | (2006.01) |
| ***A47C 4/04*** | (2006.01) |
| ***A47C 4/24*** | (2006.01) |
| ***A47C 4/28*** | (2006.01) |
| ***A47K 11/04*** | (2006.01) |

(52) U.S. Cl.

CPC ..... *A47C 5/10* (2013.01); *A47C 4/045* (2013.01); *A47C 4/24* (2013.01); *A47C 4/283* (2013.01); *A47K 11/04* (2013.01); *A47K 13/005* (2013.01)

(58) Field of Classification Search

CPC ..... A47K 13/005; A47K 3/12; A47K 11/04; A47K 17/02; A47C 4/283; A47C 4/045; A47C 4/24; A47C 5/10

USPC ..... 4/578.1, 560.1, 561.1, 562.1, 465, 479, 4/483; 297/42

See application file for complete search history.

(56) References Cited

U.S. PATENT DOCUMENTS

| | | | | | |
|---|---|---|---|---|---|
| 2,607,926 | A * | 8/1952 | De Puy | A47C 12/02 | 182/33 |
| 3,022,037 | A * | 2/1962 | Stallard | A47C 3/34 | 248/421 |
| 3,950,794 | A * | 4/1976 | Dalton | A47K 11/02 | 4/240 |
| D265,119 | S * | 6/1982 | Hurley | D23/299 | |
| D271,614 | S * | 11/1983 | Martin | D23/299 | |
| 4,493,488 | A * | 1/1985 | Panaia | A61G 5/08 | 248/157 |
| 4,823,412 | A * | 4/1989 | Spiegel | A47K 11/04 | 4/240 |
| 5,608,925 | A * | 3/1997 | Porter | A61G 5/1002 | 4/480 |
| 6,009,571 | A * | 1/2000 | Battiston | A47K 11/04 | 4/479 |

(Continued)

*Primary Examiner* — Erin Deery

(74) *Attorney, Agent, or Firm* — Pillsbury Winthrop Shaw Pittman, LLP

(57) ABSTRACT

A toilet chair includes a support frame, and a platform connected to the support frame. The platform is connected to the support frame at a first end with at least one horizontal strut. The platform is configured to move with respect to the support frame and includes at least one clamp at a second end. The at least one clamp is configured to lock the platform to the support frame at the second end forming a horizontal platform. The toilet chair also includes a toilet seat assembly connected to the platform. The toilet seat assembly is configured to support a user and move with respect to the platform.

7 Claims, 7 Drawing Sheets

(56) References Cited

U.S. PATENT DOCUMENTS

| | | | | |
|---|---|---|---|---|
| 6,176,508 | B1 * | 1/2001 | Malassigne | A61G 5/1002 280/648 |
| 6,941,591 | B2 * | 9/2005 | Battiston | A47K 11/04 4/300.3 |
| 7,500,689 | B2 * | 3/2009 | Pasternak | A61G 5/10 280/250.1 |
| 8,893,316 | B1 * | 11/2014 | Smith | A47K 17/026 4/239 |
| 2005/0125886 | A1 * | 6/2005 | Kong | A47K 11/04 4/483 |
| 2006/0169310 | A1 * | 8/2006 | Qian | A47K 11/04 135/128 |
| 2010/0243011 | A1 * | 9/2010 | Lin | A47K 11/04 135/66 |
| 2012/0055378 | A1 * | 3/2012 | Stamper | A47C 4/283 108/50.11 |
| 2015/0082527 | A1 * | 3/2015 | Grudzinski | A47K 13/005 4/239 |

* cited by examiner

PORTABLE FOLDING TOILET CHAIR

CROSS-REFERENCE TO RELATED APPLICATION(S)

This application claims priority to U.S. Provisional Patent Application 62/141,730 entitled "PORTABLE FOLDING TOILET CHAIR" filed on Apr. 1, 2015.

FIELD OF THE DISCLOSURE

The disclosure relates in general to a portable toilet and, more particularly, to a portable folding toilet chair that is sturdy and resistant to collapse.

BACKGROUND OF THE DISCLOSURE

A number of different portable toilets are available in the marketplace. Sanitation systems for camping often consist either of a fixed toilet with a large waste holding tank and a water storage reservoir or of a bucket fixed with a toilet seat.

The fixed toilet with the holding tank design generally requires some means to provide a flush of water or chemicals through a receiving chamber and into the holding tank. While this type of camp toilet has proven suitable for use in camper vehicles, boats, and for long term camping, it is not satisfactory for all outdoor uses. For example, situations where the bulk and weight of the system is not desired would make the size and weight of the camp toilets having receiving chambers, water reservoirs and holding tanks unwieldy and inconvenient.

The bucket type design generally has a toilet seat attached to a bucket including a bag-type receptacle suspended beneath the toilet seat. These systems can be more portable than the tank design due to the lack of the water reservoir and holding tank. However, they tend to be unstable, and often may collapse or overturn resulting in the undesirable outcome of spilled raw waste within the environment. Therefore, a need for a light weight yet secure and stable portable toilet chair is desirable.

SUMMARY OF THE DISCLOSURE

The disclosure relates in general to a portable toilet and, more particularly, to an portable folding toilet chair that is sturdy and resistant to collapse.

In one implementation, the present invention is a toilet chair. The toilet chair includes a support frame, and a platform connected to the support frame. The platform is connected to the support frame at a first end with at least one horizontal strut. The platform is configured to move with respect to the support frame and includes at least one clamp at a second end. The at least one clamp is configured to lock the platform to the support frame at the second end forming a horizontal platform. The toilet chair also includes a toilet seat assembly connected to the platform. The toilet seat assembly is configured to support a user and move with respect to the platform.

DETAILED DESCRIPTION

The disclosure relates in general to a portable toilet and, more particularly, to a portable folding toilet chair that is sturdy and resistant to collapse. The present portable folding toilet chair allows a user to transition between a folded portable configuration and an assembled sturdy configuration. The user can sit comfortably on the portable toilet seat without fear of the structure collapsing, tipping or overturning.

The portable folding toilet chair can also include a table surface and cup holder that are configured to be correctly oriented for holding beverages and providing a sturdy horizontal surface when extended from the portable folding toilet chair.

Figure 1:
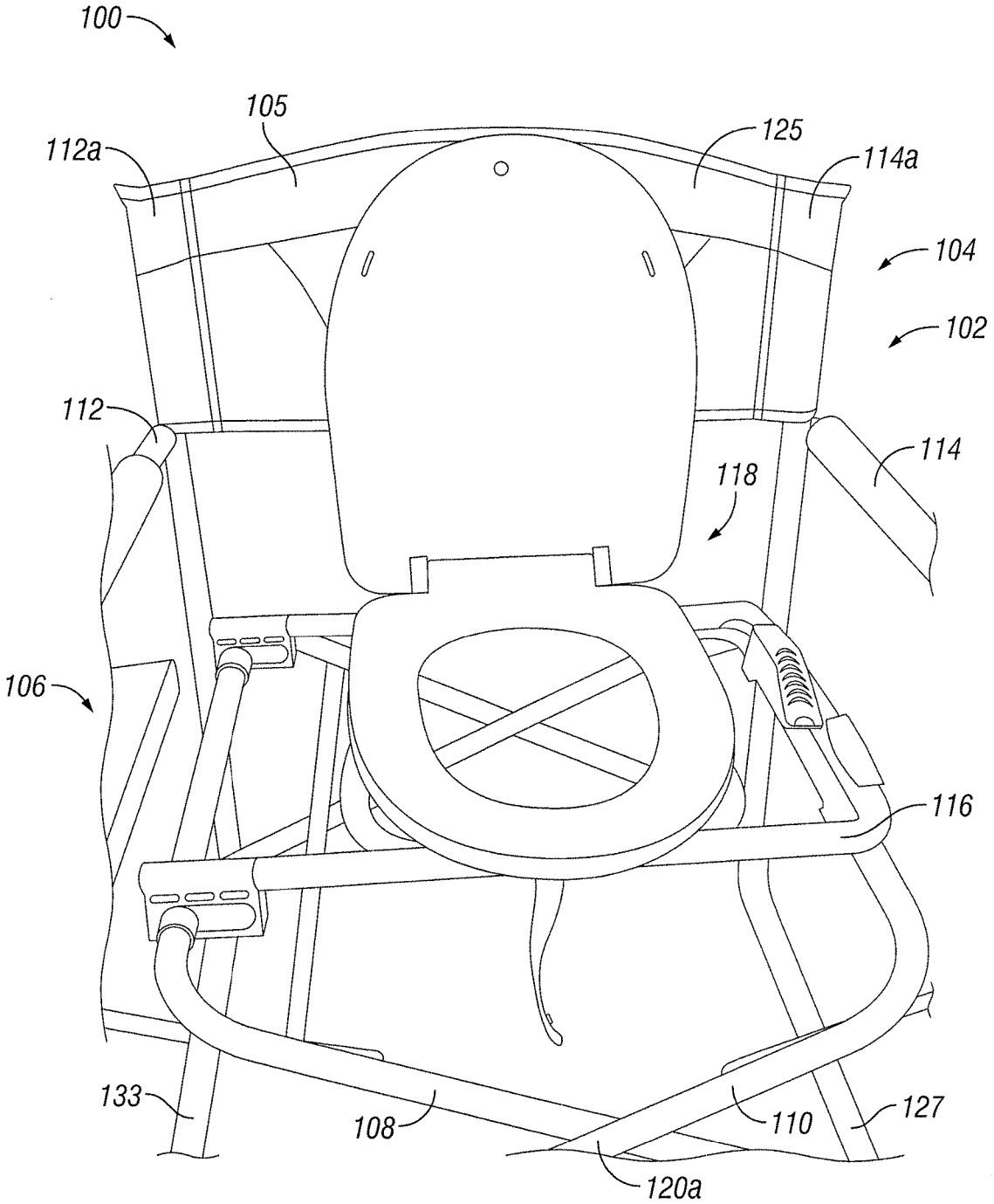
FIG. 1 illustrates the portable folding toilet chair in its assembled configuration, according to an embodiment of the invention.
Figure 2:
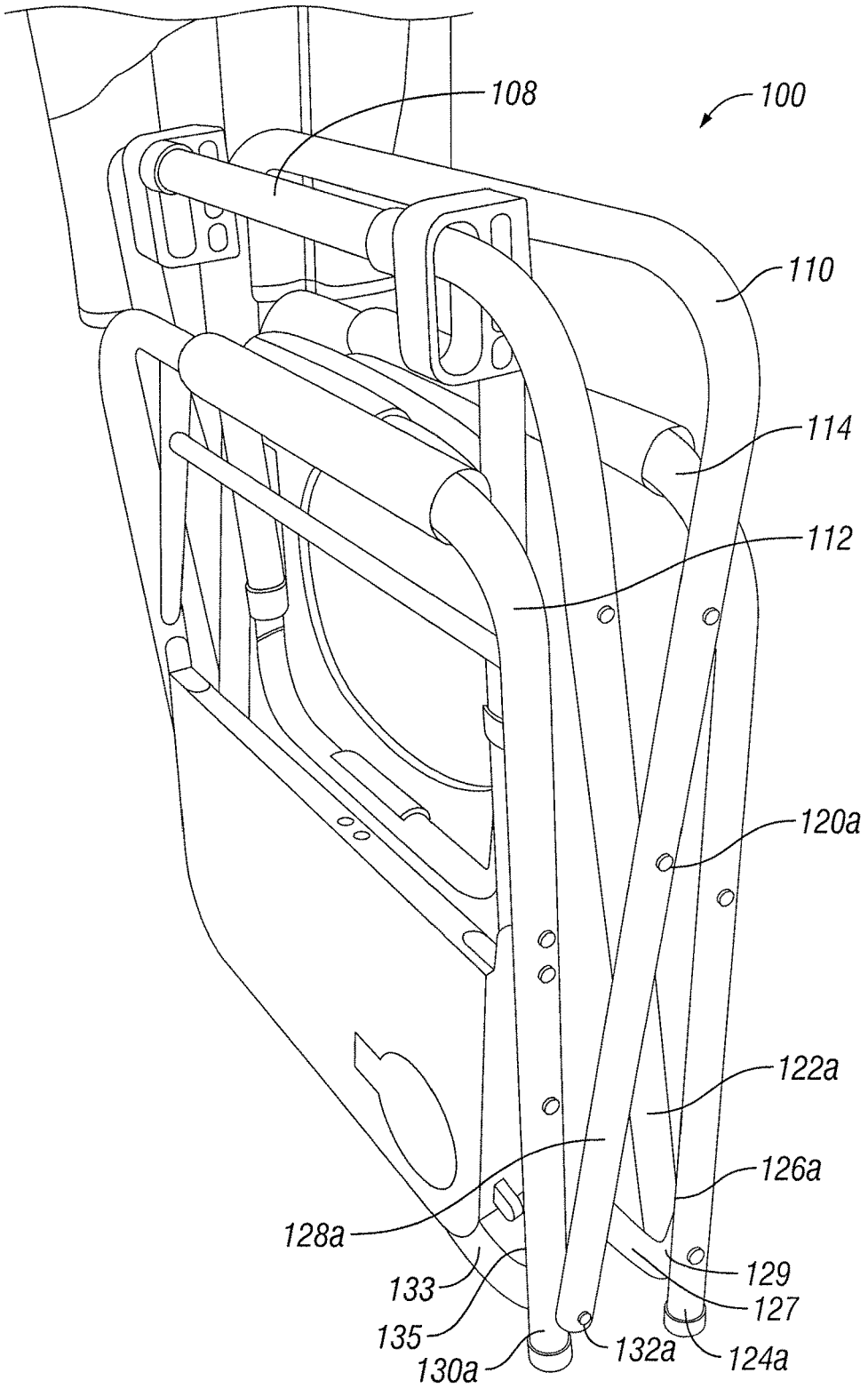
FIG. 2 illustrates the portable folding toilet chair of FIG. 1 in its folded or collapsed configuration that allows for easier transportation and storage, according to an embodiment of the invention.
Figure 3:
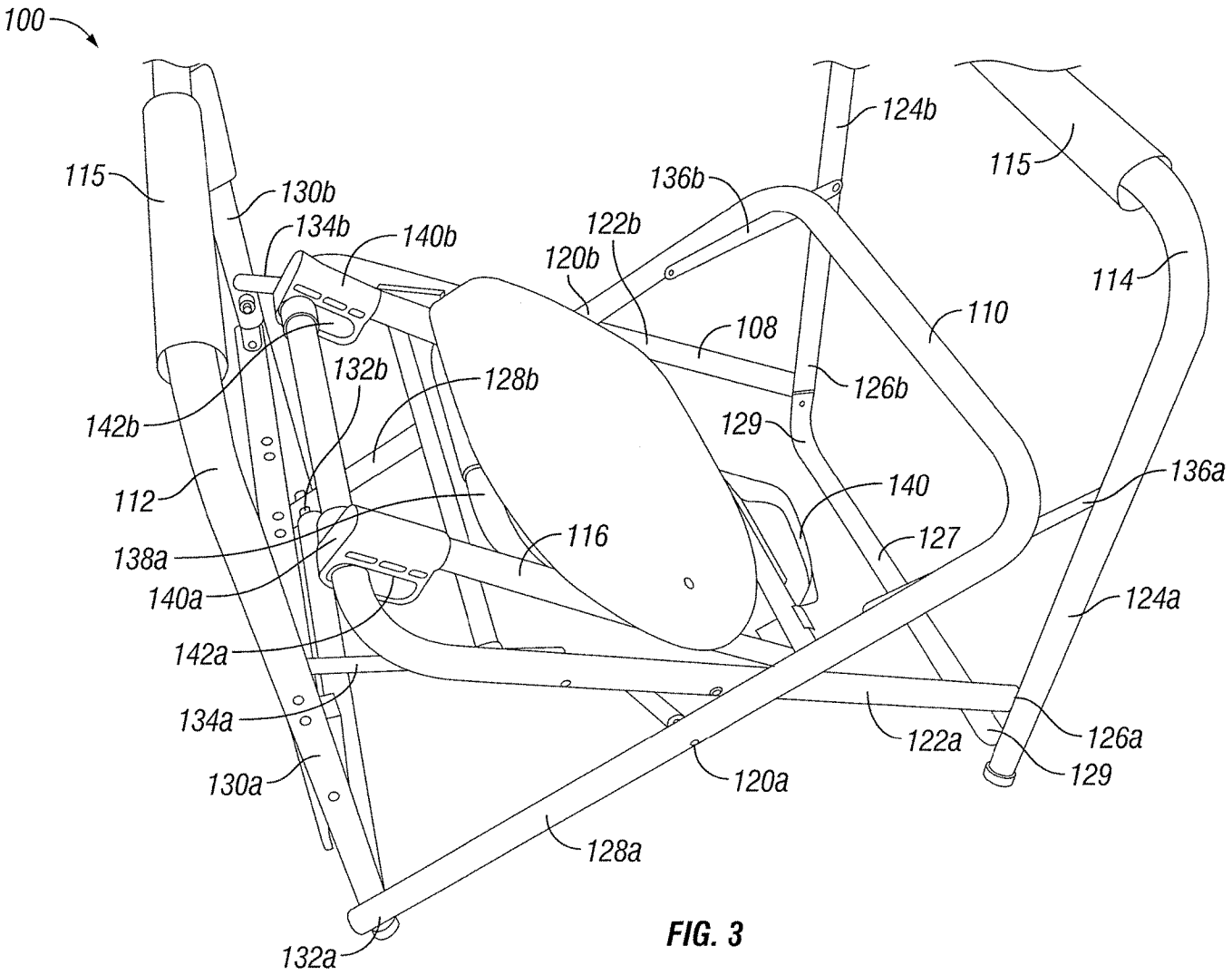
FIG. 3 shows a view of the portable folding toilet chair of FIGS. 1 and 2 being extended from its folded configuration as shown in FIG. 2 into a deployed position, according to an embodiment of the invention.
Figure 4:
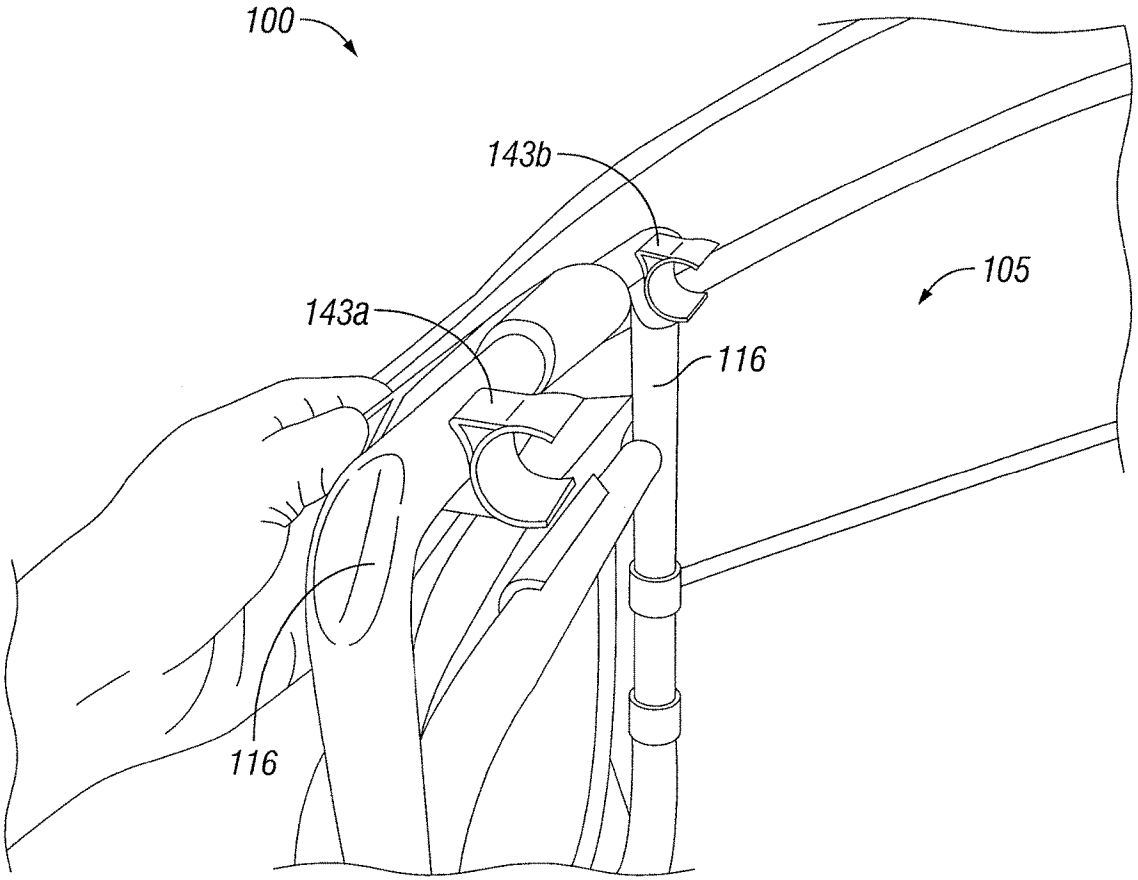
FIG. 4 shows a side view of the frame of the portable folding toilet chair of FIGS. 1-3 illustrating two clamp brackets on the stabilizing platform rod of the toilet seat assembly that clamp to the chair structure rods to provide a stable toilet seat assembly platform, according to an embodiment of the invention.

FIGS. 1-7 show various views of the portable folding toilet chair 100 in different view angles and in different configurations. FIG. 1 shows a perspective view of the portable folding toilet chair 100 in a fully assembled configuration. FIG. 2 shows a perspective view of the portable folding toilet chair 100 in a fully folded or collapsed configuration. FIG. 3 shows a side view of the portable folding toilet chair 100 in a partially folded or collapsed configuration. FIG. 4 shows a close side view of two clamp brackets on the stabilizing platform rod of the toilet seat assembly that clamp to the portable folding chair 100 structure rods to provide a stable toilet seat assembly platform. In FIGS. 1-7 some element numbers have not been duplicated across all figures where features of the frame have been obscured by a different view or to avoid unnecessary clutter of the drawings. However, FIGS. 1-7 should be considered to show different views of the same frame structure where a numbered component in one view is shown in all views, even if not identified with an element number in a different figure.

As shown in FIG. 1, portable folding toilet chair 100 includes frame 102 having a chair frame 104 and support structure 106. Chair frame 104 includes a back support 105 connected to the support structure 106. Support structure 106 provides support for portable folding toilet chair 100 and is made up of five u-shaped tubular members, a left frame member 108, a right frame member 110, a left arm rest 112 and a right arm rest 114 (shown in FIG. 2), and is interconnected by a stabilizing platform rod 116 which supports toilet seat assembly 118.

Left frame member 108 and right frame member 110 of support structure 106 are pivotally connected intermediate their lengths by pins 120*a* and 120*b*.

As shown in FIGS. 2 and 3, u-shaped left frame member 108 of support structure 106 includes leg portions 122*a* and 122*b* while right arm rest 114 includes leg portions 124*a* and 124*b*. Each of leg portions 122*a* and 122*b* are pivotally connected at a distal end to leg portions 124*a* and 124*b*, respectively at pivot points 126*a* and 126*b*. Likewise, u-shaped right frame member 110 of support structure 106 includes leg portions 128*a* and 128*b* while left arm rest 112 includes leg portions 130*a* and 130*b*. Each of leg portions 128*a* and 128*b* are pivotally connected at the distal end to leg portions 130*a* and 130*b*, respectively at pivot points 132*a* and 132*b*.

Left support bars 134*a* and 134*b* pivotally connect each side of the u-shaped portion of left frame member 108 to leg portions 130*a* and 130*b* (shown in FIG. 3). Similarly, right support bars 136*a* and 136*b* pivotally connect each side of the u-shaped portion of right frame member 110 to leg portions 124*a* and 124*b*.

Leg stretcher 127 is connected to leg portions 124*a* and 124*b* of right arm rest 114 at curved distal ends 129 to provide balance and support to assembled portable folding toilet chair 100. Similarly, leg stretcher 133 is connected to leg portions 130*a* and 130*b* of left arm rest 112 at curved distal ends 135 also to provide balance and support to assembled portable folding toilet chair 100.

Referring back to FIG. 1, back support 105 of chair frame 104 is used to connect left arm rest 112 and right arm rest 114 to chair frame 104. To provide the back support 105 upon which a user rests, a fabric, or other material, is connected between the back support rods 112*a* and 114*a* of left arm rest 112 and right arm rest 114, respectively. As shown in FIG. 1, fabric 125 includes a sleeve allowing fabric 125 to be attached by sliding over back support rods 112*a* and 114*a* of portable folding toilet seat 100. Fabric 125 provides a surface upon which a user may lean back on when using portable folding toilet chair 100. Although the fabric shown in FIG. 1 is shown as a largely contiguous surface, fabric 125 may instead be replaced by a number of straps that extend across the width of chair frame 104.

As shown in FIG. 3, left frame member 108 of support structure 106 includes a u-shaped stabilizing platform rod 116. Stabilizing platform rod 116 includes toilet seat supports 138*a* and 138*b* and is connected to left frame member 108 via hinge members 140*a* and 140*b* (shown in FIG. 3). Each of hinge members 140*a* and 140*b* have oval openings 142*a* and 142*b* respectively. Left frame member 108 is threadedly attached normal to stabilizing platform rod 116 through oval openings 142*a* and 142*b* so that the stabilizing platform rod 116 may rotate freely and translate laterally about the left frame member 108 via hinge members 140*a* and 140*b*.

In an embodiment, and as shown in FIG. 3, arm rest sleeves 115 of left arm rest 112 and right arm rest 114 provide comfort to the user as well as increased gripping capacity.

As leg portions of left frame member 108 and right frame member 110 of support structure 106 are pivotally connected to arm rest leg portions, portable folding toilet chair 100 can be folded so that arm rests 112 and 114 come together for portability, or may be pulled away from one another, to provide a stable support for stabilizing platform rod 116 and supporting toilet seat assembly 118 when assembled.

As shown in FIG. 3, stabilizing platform rod 116 includes a grab handle 140 centered outward of the u-shaped portion of stabilizing platform rod 116. Stabilizing platform rod 116 further includes two generally C-shaped clamps 143*a* and 143*b* perpendicular to grab handle 140 and formed on the bottom of stabilizing platform rod 116 (shown in FIG. 4). Clamps 143*a* and 143*b* are configured to removably couple to right frame member 110.

To assemble the portable folding toilet chair 100 from the folded configuration shown in FIG. 2, each of arm rests 112 and 114 are pulled away from one another as shown in FIG. 3. Next, stabilizing platform rod 116 may be lifted by grab handle 140, rotating stabilizing platform rod 116 upward about left frame member 108 so that the u-shaped portion of stabilizing platform rod 116 clears right frame member 110. Once cleared, C-shaped clamps 143*a* and 143*b* on the bottom of stabilizing platform rod 116 (see FIG. 4) can be clamp locked to the u-shaped portion of right frame member 110 to form a fixed platform for toilet seat assembly 118 that is strong, durable, and tip resistant. A disposable waste bag can be attached to the underside of toilet seat 148.

As shown in FIGS. 2 and 3 and now discussed in more detail, hinge members 140*a* and 140*b* include oval openings 142*a* and 142*b*. Oval openings 142*a* and 142*b* are of sufficient size to allow for rotational movement of the stabilizing platform rod 116 about the rounded portions of openings 142*a* and 142*b* as well as lateral translational movement along the lateral length of the oval openings 142*a* and 142*b* with respect to the left frame member 108.

This combination of rotational and lateral movement of hinge members 140*a* and 140*b* allows stabilizing platform rod 116 to be tucked under right frame member 110 when the portable folding toilet chair 100 is in the collapsed and folded configuration. During assembly of the portable folding toilet chair 100 into a deployed configuration, the rotational movement of hinge members 140*a* and 140*b* allows the stabilizing platform rod 116 to rotate upward toward right frame member 110. The lateral movement of the hinge members 140*a* and 140*b* subsequently provides for lateral extension of the stabilizing platform rod 116 upward clearing right frame member 110. The lateral movement of the hinge members 140*a* and 140*b* further provides for lateral extension of the stabilizing platform rod 116 on top of and across the right frame member 110 allowing clamps 143*a* and 143*b* on the bottom surface of stabilizing platform rod 116 to be placed on top of and normal to right frame member 110 (as shown in FIG. 1). Thus, secure horizontal positioning of the stabilizing platform rod 116 is achieved by positioning clamps 143*a* and 143*b* normal to right frame member 110 allowing for the removable locking mechanism of clamps 143*a* and 143*b* to be secured onto right frame member 110 of support structure 106. Such positioning of the stabilizing platform rod 116 secured horizontally on top of the right frame member 110 will provide for a sturdy and tilt resistant deployed configuration of the portable folding toilet chair 100.

Figure 5:
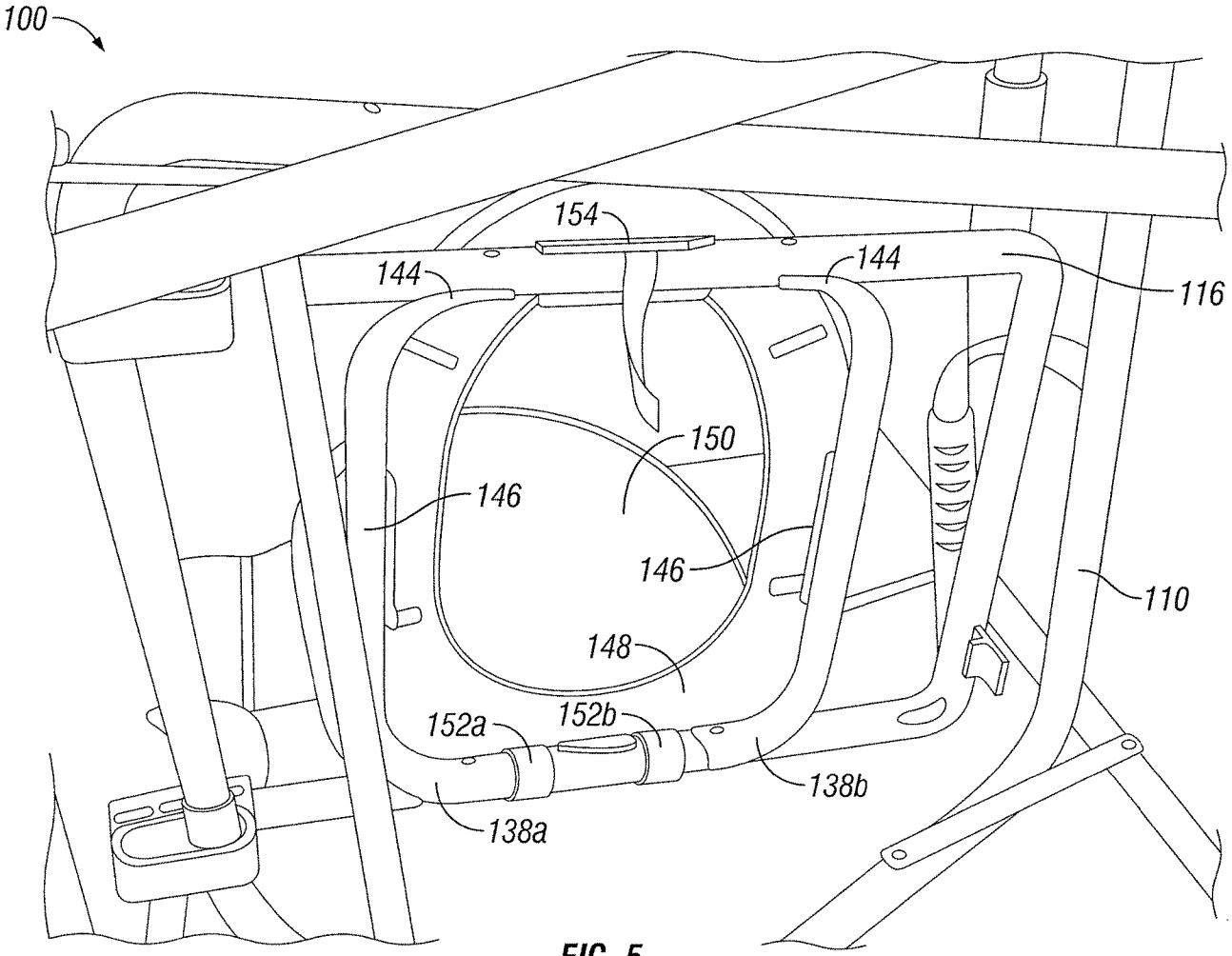
FIG. 5 shows a view of the portable folding toilet chair of FIGS. 1-4 illustrating the underside of the toilet seat assembly and stabilizing platform rod as shown in FIG. 4, according to an embodiment of the invention.

Referring to FIG. 5, toilet seat supports 138*a* and 138*b* of support structure 106 are illustrated connected to stabilizing platform rod 116 at curved distal ends 144. Toilet seat supports 138*a* and 138*b* also include cushion sleeves 146 intermediate their lengths for receiving a toilet seat 148 of toilet seat assembly 118.

Toilet seat assembly 118 includes toilet seat 148 and a toilet seat lid 150 for covering and closing the toilet seat assembly 118. Toilet seat assembly 118 is shown in FIG. 5 as attached with sleeve-rings 152*a* and 152*b* to stabilizing platform rod 116 so that the toilet seat lid 150 may freely rotate about the stabilizing platform rod 116 to provide an open or closed configuration for toilet seat assembly 118 during use of the portable folding toilet chair 100. Also shown in FIG. 5 is stabilizing platform rod 116 which includes a cushion sleeve 154 for secure attachment of the front opening lip 156 of toilet seat 148 to the stabilizing platform rod 116.

Figure 6:
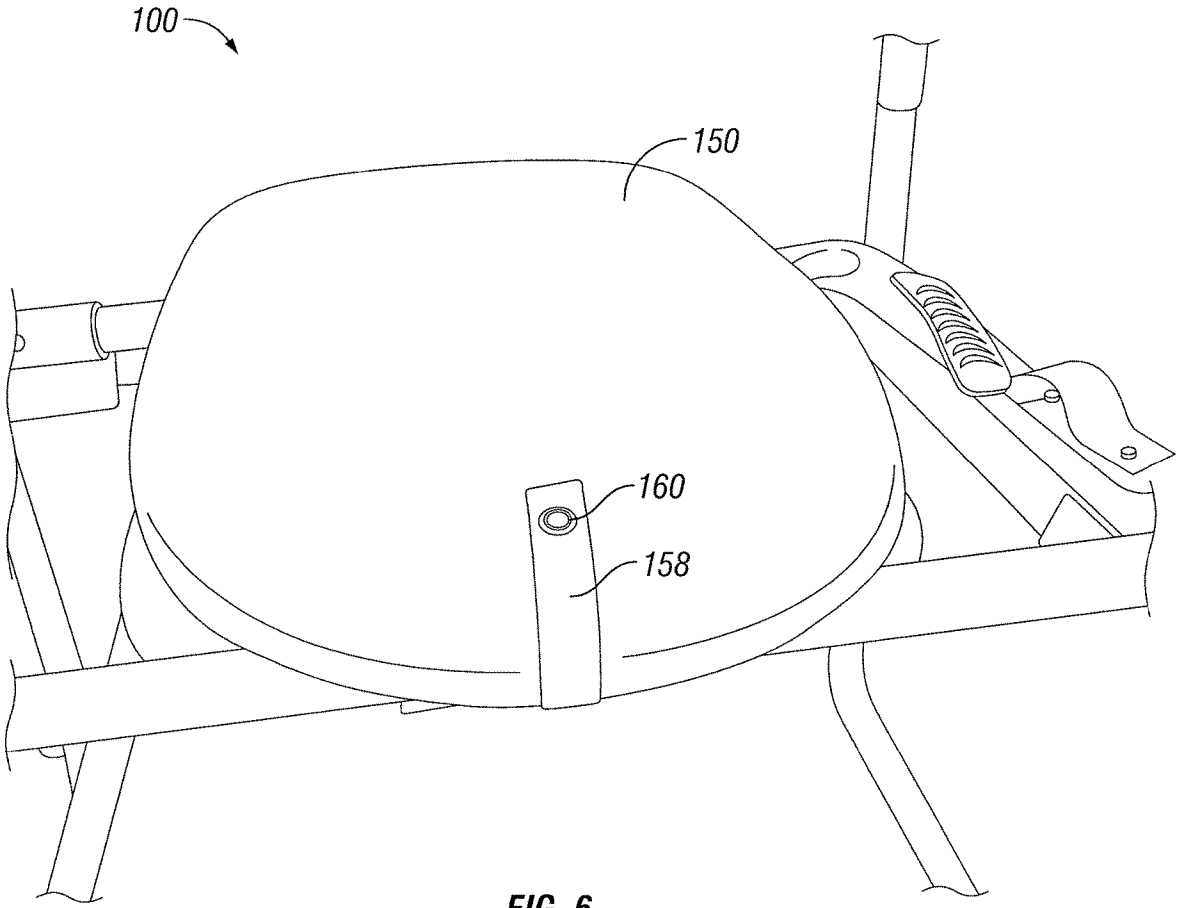
FIG. 6 shows a view of the portable folding toilet chair of FIGS. 1-5 illustrating the toilet seat lid in the closed position anchored by a securing strap and snap, according to an embodiment of the invention.

In an embodiment, and as shown in FIG. 6, the portable folding toilet chair 100 may include a toilet lid strap 158 and fastener 160 to enable the user to close and lock the toilet seat lid 150 closed.

In an embodiment, support structure 106 can be constructed from a tubular material such as steel or aluminum. Although back support 105 of support structure 106 is illustrated using a solid fabric, back support 105 can be constructed of webbing, slats, or solids of fabric, cloth, or plastic. FIGS. 1-7 show the tubular structural components of portable folding toilet chair 100.

Figure 7:
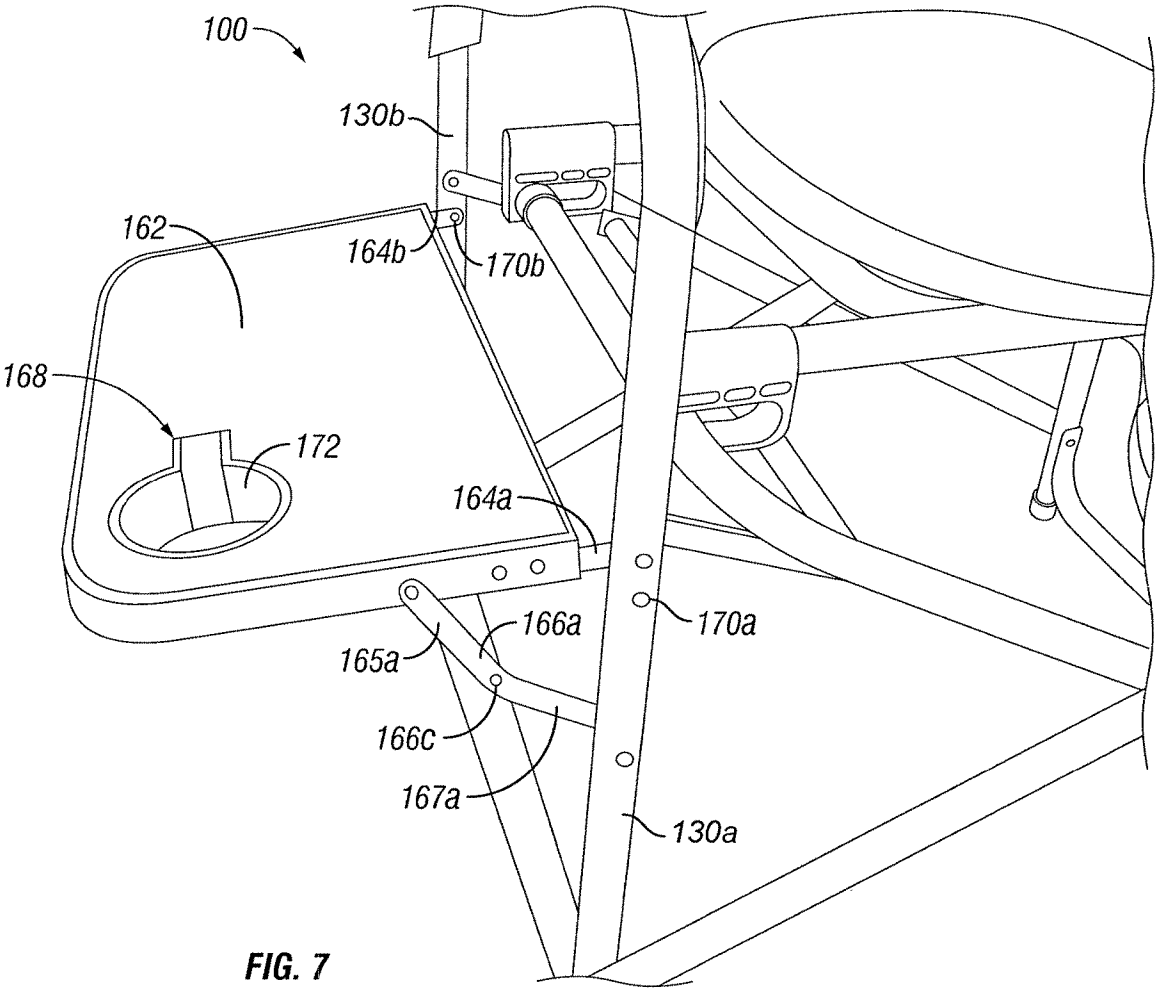
FIG. 7 shows a view of the portable folding toilet chair of FIGS. 1-6 illustrating a foldable table as an accessory, in the assembled position which further provides a cup holder, according to an embodiment of the invention.

In an embodiment, and as shown in FIG. 7, the portable folding toilet chair 100 may include a side table 162 including table support beams 164*a* and 164*b*, folding angle irons (including folding angle iron 166*a*), and cup holder 168. Table support beams 164*a* and 164*b* are statically connected to side table 162 and pivotally connected to arm rest 112 so that side table 162 and table support beam 164 rotate from pivot pins 170. Folding angle irons (folding angle iron 166*a* is shown in FIG. 7) are pivotally attached to leg portions 130*a* and 130*b*, respectively, intermediate to the leg portions length to support side table 162. Folding angle iron 166*a* comprises two pivotally attached sections, 165*a* and 167*a* joined at locking pivot pins 166*c*. A second folding angle iron (not shown) is symmetrically configured to provide locking support to support beam 164*b* in an identical manner as is provided by folding angle iron 166*a* to support beam 164*a*. Locking pivot pin 166*c* is configured to lock section 165*a* and 167*a* in a longitudinal manner to provide horizontal support for side table 162 and support beam 164*a*.

Once portable folding toilet chair 100 has been fully assembled, side table 162 is configured to remain in a folded configuration or may be elevated to provide the horizontal table shown in FIG. 7 in an assembled configuration.

To assemble side table 162, table support beams 164*a* and 164*b* are lifted to elevate side table 162 into a horizontal position. Once side table 162 has been placed in a horizontal position, angle irons 166*a* and 166*b* are locked at pivot pins 166*c* and 166*d* to provide the sturdy horizontal surface of side table 162 shown in FIG. 7.

Side table 162 can be collapsed to return to a folded configuration. To collapse the side table 162, locking pivot pins 166*c* and 166*d* are released and table support beams 164*a* and 164*b* are lowered to a vertical position by rotation about pivot pins 170.

Cup holder 168 includes a body 172 sized to receive a beverage container. Body 172 includes floor 174 configured to support the beverage container when a container is positioned within body 172 of cup holder 168.

In one implementation of the portable folded toilet chair 100, the geometry of the components of portable folding toilet chair 100 are as follows. The width of the frame of portable folding toilet chair 100 is approximately 610 millimeters (mm). The length of toilet seat assembly 118 is approximately 503 mm. The length of back 108 from the top of back 108 to connection 128 is approximately 996 mm. The length of the u-portion of the arm rests 112 and 114 are approximately 559 mm. The dimensions provided above are only one example of an implementation of portable folding toilet chair 100. Other portable folding toilet chairs having other dimensions may be constructed. In some cases, the geometry of the chair can be adjusted to meet particular design needs. For example, in one implementation the height of toilet seat 148 may be raised to assist the handicapped or the elderly.

Portable folding toilet chair 100 can also be disassembled into a collapsed folded configuration. FIG. 2, for example, shows portable folding toilet chair 100 in a collapsed folded configuration that allows for easier transportation and storage.

To collapse portable folding toilet chair 100, the waste bag is removed and toilet seat lid 150 is closed using toilet lid securing strap 158 and fastener 160 as shown in FIG. 6. Next, by using grab handle 140 of the u-shaped portion of stabilizing platform rod 116, clamps 143*a* and 143*b* can be unlocked and removed from the u-shaped portion of right frame member 110 releasing the stabilizing platform 116 from the right frame member 110. Once the stabilizing platform rod 116 is released, it can freely move laterally leftward from right frame member 110 and rotate downward from the u-shaped portion of left frame member 108 (as shown in FIG. 3) to tuck below right frame member 110. Next, as arm rests 112 and 114 are moved together, both left frame member 108 and right frame member 110 pivotally fold upwards to a vertical position as shown in FIG. 2.

Although the present invention has been described with respect to preferred embodiment(s), any person skilled in the art will recognize that changes may be made in form and detail, and equivalents may be substituted for elements of the invention without departing from the spirit and scope of the invention. Therefore, it is intended that the invention not be limited to the particular embodiments disclosed for carrying out this invention, but will include all embodiments falling within the scope of the appended claims.

What is claimed is:

1. A device, comprising:

a support frame;

a strut including a first end connected to the support frame by a bracket, the bracket defining an oval opening formed around a first portion of the support frame, the bracket being configured to enable rotation of the strut around the first portion of the support frame and translational movement of the strut towards the first portion of the support frame into a first position with respect to the first portion of the support frame and away from the first portion of the support frame into a second position with respect to the first portion of the support frame, the strut including a clamp at a second end of the strut, and wherein:

when the strut is in the second position with respect to the first portion of the support frame, the clamp is configured to attach the strut to a second portion of the support frame at the second end of the strut, and when the strut is in the first position with respect to the first portion of the support frame, the strut is configured to rotate about the first portion of the support frame without either the strut or the clamp contacting the second portion of the support frame; and a toilet seat assembly connected to the strut, the toilet seat assembly being configured to support a user and move with respect to the strut.

2. The device of claim 1, further comprising a table pivotally connected to the support frame and configured to move with respect to the support frame.

3. A device, comprising:

a support frame; and a platform connected to a strut, the strut configured to move with respect to the support frame, the strut including a first end and a second end, the strut including clamps at the second end, the clamps configured to lock the strut to the support frame at the second end, wherein the first end of the strut is connected to the support frame by a bracket, the bracket defining an oval opening formed around at least one portion of the support frame, the bracket being configured to enable rotation of the strut around the at least one portion of the support frame, without the clamps of the strut contacting the support frame, and the bracket being configured to also enable translational movement of the strut towards or away from the at least one portion of the support frame.

4. The device of claim 3, wherein the platform includes a toilet seat assembly, wherein the toilet seat assembly is configured to support a user thereon.

5. The device of claim 4, wherein the toilet seat assembly includes a toilet seat, a toilet seat lid, and a locking mechanism for the toilet seat lid to secure the toilet seat lid in a closed position.

6. The device of claim 3, including at least one arm rest, the at least one arm rest being pivotally connected to the support frame and configured to move with respect to the support frame.

7. The device of claim 3, further comprising a table pivotally connected to the support frame and configured to move with respect to the support frame.

* * * * *